US008613625B2

(12) United States Patent
Costa et al.

(10) Patent No.: US 8,613,625 B2
(45) Date of Patent: Dec. 24, 2013

(54) NETWORK COMPONENT COMPRISING AN ELECTRICAL DEVICE

(75) Inventors: Jean-Paul Costa, Domdidier (CH); Thomas Staeubli, Zürich (CH)

(73) Assignee: Saia-Burgess Controls AG (CH)

( * ) Notice: Subject to any disclaimer, the term of this patent is extended or adjusted under 35 U.S.C. 154(b) by 0 days.

(21) Appl. No.: 13/296,602

(22) Filed: Nov. 15, 2011

(65) Prior Publication Data

US 2012/0129367 A1 May 24, 2012

(30) Foreign Application Priority Data

Nov. 23, 2010 (EP) ..... 10192155

(51) Int. Cl.
*H01R 25/00* (2006.01)

(52) U.S. Cl.
USPC ..... 439/116; 439/425

(58) Field of Classification Search
USPC ..... 439/391, 411, 412, 417, 425, 431, 110, 439/116–122
See application file for complete search history.

(56) References Cited

U.S. PATENT DOCUMENTS

| | | | | | |
|---|---|---|---|---|---|
| 4,075,758 | A | * | 2/1978 | Parsons et al. | 29/866 |
| 4,508,399 | A | * | 4/1985 | Dowling et al. | 439/67 |
| 4,758,536 | A | * | 7/1988 | Miller et al. | 439/138 |
| 4,934,953 | A | * | 6/1990 | Tenham et al. | 439/417 |
| 5,059,137 | A | * | 10/1991 | Dale et al. | 439/395 |
| 5,064,380 | A | * | 11/1991 | Dale et al. | 439/113 |
| 5,453,022 | A | * | 9/1995 | Staiger et al. | 439/404 |
| 5,501,611 | A | | 3/1996 | Staiger et al. | 439/404 |
| 5,556,297 | A | * | 9/1996 | Bray et al. | 439/405 |
| 5,704,801 | A | * | 1/1998 | Walker et al. | 439/417 |
| 5,722,852 | A | * | 3/1998 | Miek | 439/417 |
| 5,855,491 | A | * | 1/1999 | Hintner et al. | 439/409 |
| 5,934,930 | A | * | 8/1999 | Camps et al. | 439/425 |
| 6,022,240 | A | * | 2/2000 | McCleerey et al. | 439/410 |
| 6,025,982 | A | | 2/2000 | Brower | 361/119 |
| 6,027,367 | A | * | 2/2000 | Woertz et al. | 439/497 |
| 6,039,596 | A | * | 3/2000 | Whiteman et al. | 439/404 |
| 6,083,035 | A | * | 7/2000 | Mackey et al. | 439/410 |
| 6,095,867 | A | * | 8/2000 | Brandt et al. | 439/620.09 |
| 6,099,343 | A | * | 8/2000 | Bonvallat et al. | 439/412 |
| 6,123,585 | A | * | 9/2000 | Hussong et al. | 439/652 |
| 6,142,815 | A | * | 11/2000 | Whiteman et al. | 439/381 |
| 6,179,644 | B1 | * | 1/2001 | Adams et al. | 439/387 |

(Continued)

FOREIGN PATENT DOCUMENTS

| | | |
|---|---|---|
| DE | 195 10 507 | 9/1996 |
| FR | 2 919 424 | 1/2009 |
| WO | WO 99/65114 | 12/1999 |

OTHER PUBLICATIONS

European Search Report mailed Apr. 8, 2011 in corresponding European Application No. EP 10192155.

(Continued)

*Primary Examiner* — Ross Gushi
(74) *Attorney, Agent, or Firm* — Ostrolenk Faber LLP

(57) ABSTRACT

A network component includes an electrical device (10) for exchanging signals via a communication line (1) of a network. The electrical device (10) is configured to be connected electrically to wires (3) of the communication line (1) and includes pins (20), which are configured to pierce the insulation material (2) enclosing the wires (3) of the communication line (1).

21 Claims, 3 Drawing Sheets

(56) References Cited

U.S. PATENT DOCUMENTS

| | | | | |
|---|---|---|---|---|
| 6,196,863 | B1 * | 3/2001 | Schwant | 439/417 |
| 6,200,157 | B1 * | 3/2001 | Ams et al. | 439/409 |
| 6,232,557 | B1 * | 5/2001 | Lounsbury et al. | 174/117 F |
| 6,261,119 | B1 * | 7/2001 | Green | 439/425 |
| 6,273,750 | B1 * | 8/2001 | Malkowski, Jr. | 439/499 |
| 6,290,365 | B1 * | 9/2001 | Schlesinger | 362/84 |
| 6,383,013 | B1 * | 5/2002 | Ghesla et al. | 439/417 |
| 6,421,219 | B1 | 7/2002 | Brower | 361/119 |
| 6,544,068 | B1 * | 4/2003 | Hatton | 439/425 |
| 6,551,124 | B1 * | 4/2003 | Gossmann | 439/411 |
| 6,648,672 | B1 * | 11/2003 | Meinke | 439/422 |
| 6,692,292 | B2 * | 2/2004 | Huiskamp et al. | 439/417 |
| 6,716,055 | B1 * | 4/2004 | Echito | 439/417 |
| 6,721,184 | B1 * | 4/2004 | Lehmeier et al. | 361/728 |
| 6,743,042 | B2 * | 6/2004 | Kolle et al. | 439/417 |
| 6,848,933 | B1 * | 2/2005 | Delaney et al. | 439/392 |
| 6,984,147 | B2 * | 1/2006 | Tricaud et al. | 439/509 |
| 7,063,556 | B1 * | 6/2006 | Wong et al. | 439/412 |
| 7,114,841 | B2 * | 10/2006 | Aanegola et al. | 362/640 |
| 7,156,689 | B2 * | 1/2007 | Fabian et al. | 439/417 |
| 7,210,957 | B2 * | 5/2007 | Mrakovich | 439/404 |
| 7,273,389 | B2 * | 9/2007 | Hoppach et al. | 439/425 |
| 7,322,848 | B2 * | 1/2008 | Hatton | 439/425 |
| 7,445,488 | B2 * | 11/2008 | Feldmeier et al. | 439/394 |
| 7,497,720 | B2 * | 3/2009 | Kathan et al. | 439/404 |
| 7,635,279 | B1 * | 12/2009 | Wong et al. | 439/419 |
| 7,922,516 | B2 * | 4/2011 | Temblador et al. | 439/431 |
| 8,025,524 | B2 * | 9/2011 | Temblador et al. | 439/431 |
| 8,303,330 | B2 * | 11/2012 | Temblador et al. | 439/431 |
| 2003/0049961 | A1 * | 3/2003 | Tricaud et al. | 439/417 |
| 2003/0207609 | A1 * | 11/2003 | Hatton | 439/425 |
| 2004/0156198 | A1 * | 8/2004 | Chen | 362/226 |
| 2006/0128205 | A1 * | 6/2006 | Wong et al. | 439/412 |
| 2006/0223361 | A1 * | 10/2006 | Hoppach et al. | 439/425 |
| 2007/0173104 | A1 * | 7/2007 | Veronesi et al. | 439/425 |
| 2009/0258532 | A1 * | 10/2009 | Beier et al. | 439/391 |
| 2010/0093206 | A1 * | 4/2010 | Chuen | 439/391 |
| 2010/0099296 | A1 * | 4/2010 | Temblador et al. | 439/431 |
| 2010/0204806 | A1 | 8/2010 | Chowaniec et al. | 700/19 |
| 2010/0229479 | A1 * | 9/2010 | Burkhard et al. | 52/204.1 |
| 2011/0177713 | A1 * | 7/2011 | Temblador et al. | 439/411 |
| 2011/0195597 | A1 * | 8/2011 | Park | 439/395 |
| 2011/0250781 | A1 * | 10/2011 | Onodi et al. | 439/391 |
| 2012/0129366 | A1 * | 5/2012 | Costa et al. | 439/110 |
| 2012/0129367 | A1 * | 5/2012 | Costa et al. | 439/116 |

OTHER PUBLICATIONS

European Search Report mailed Apr. 5, 2011 in corresponding European Application No. EP 10192156.

* cited by examiner

NETWORK COMPONENT COMPRISING AN ELECTRICAL DEVICE

FIELD OF THE INVENTION

The present invention relates to a network component comprising an electrical device for exchanging signals via a communication line of a network.

BACKGROUND OF THE INVENTION

In order to exchange signals via a communication line of a network, electrical devices are to be connected electrically to the wires of the communication line. Such connections known by the art make use of additional connectors, wires or the like and are thus relatively complicated to be established.

SUMMARY OF THE INVENTION

It is an aim of the present invention to provide for a network component, whose electrical device can be connected to the communication line of the network in a simplified manner.

This aim is achieved by a network component comprising an electrical device, which includes pins that are configured to pierce the insulation material enclosing the wires of the communication line. The provision of such pins allows a simplified connection of the electrical device to the communication line.

BRIEF DESCRIPTION OF THE DRAWINGS

The invention is explained in the following by means of an exemplary embodiment with reference to Figures. In the drawings.

DETAILED DESCRIPTION OF THE PREFERRED EMBODIMENTS

Figure 1:
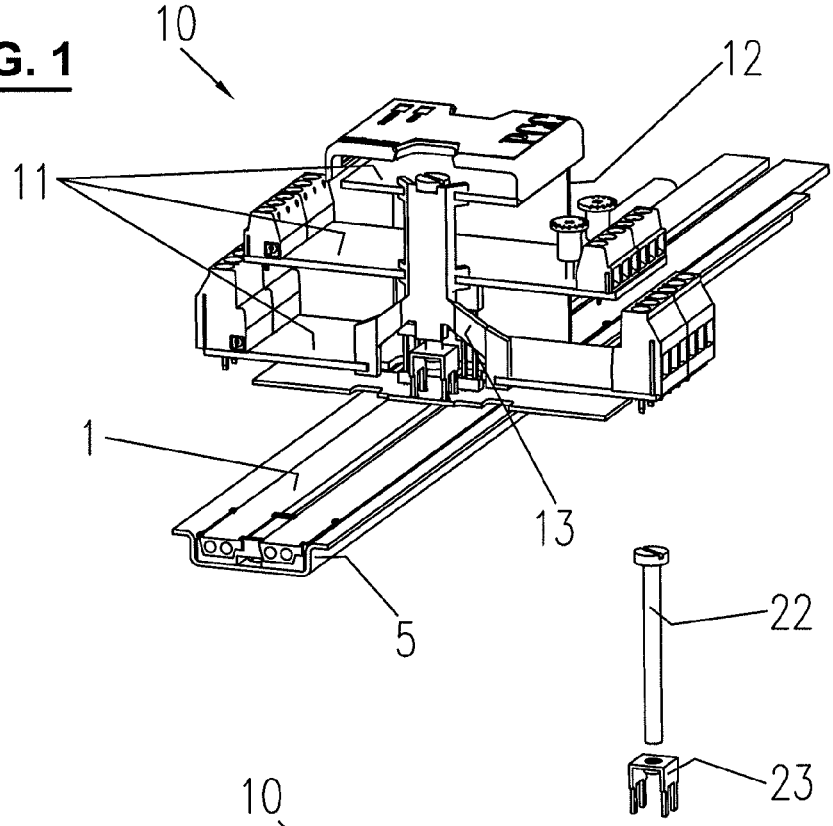
FIG. 1 shows a perspective view of a network component according to the invention, wherein part of the housing is removed.
Figure 2:
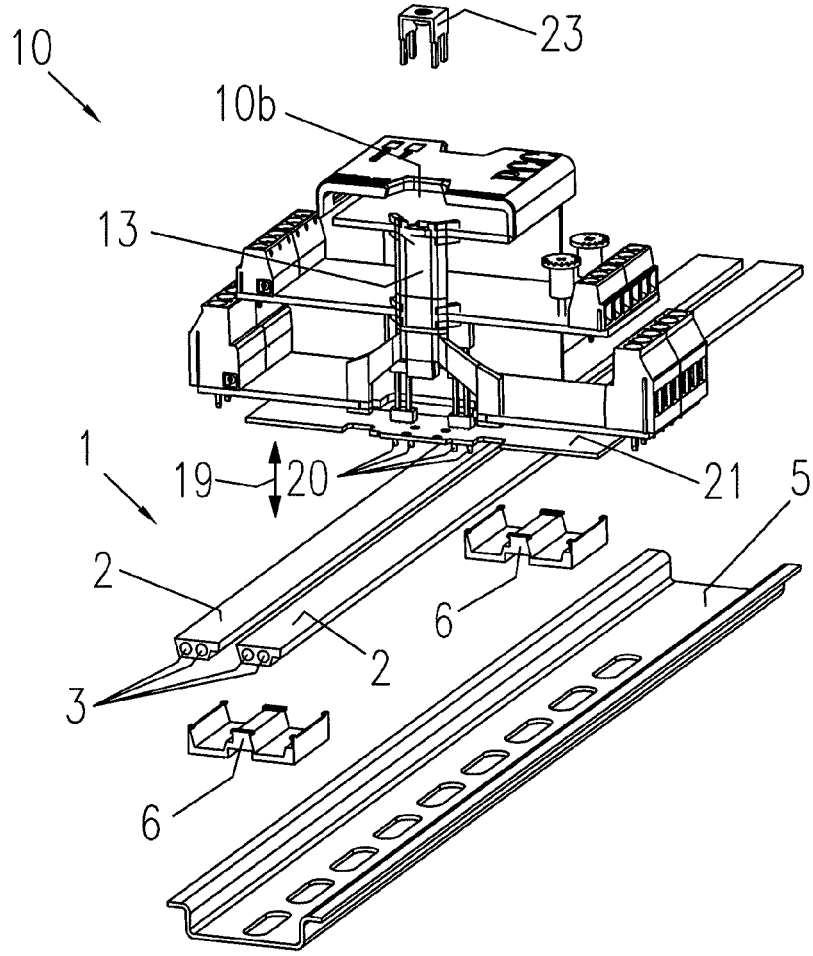
FIG. 2 shows an explosive view of the network component according to FIG. 1.

FIGS. 1 and 2 show a network component, i.e. a part of a network comprising a communication line 1 and a control device 10. The communication line 1 serves for exchanging signals among different control devices and may be configured as a bus (e.g. Profibus, CAN-bus, EIB, etc.), ethernet or in the form of any other line suitable for communication. In the embodiment shown here the communication line 1 comprises two cables. Each cable comprises an insulation jacket 2 which encloses two wires 3 and has an upper and a lower surface, which are substantially flat.

The communication line 1 runs in a channel of a mounting rail 5. The mounting rail 5 is e.g. a rail according to the norm "EN 60715 DA 38" or any other rail suitable for carrying a communication line 1 and control devices. The mounting rail 5 shown here comprises lateral wings which are arranged adjacent to the channel and holes formed in the channel for attaching the mounting rail 5 to a mounting surface, e.g. a wall, by means of screws or the like.

Cable holders 6 which hold the cables 2 are arranged successively in the channel of the mounting rail 5. The cable holders 6 serve for defining the lateral position of the wires 3 within the mounting rail 5. Instead of providing separate cable holders 6 or in addition to such cable holders 6, it is conceivable to shape the outer form of communication line 1 such that suitable elements for holding it in the mounting rail 5 are integrated in the insulation jacket 2.

The detailed construction of the control device 10 depends on its specific application. In the embodiment shown in FIGS. 1 and 2, the control device 10 comprises three plates 11, which are arranged on top of each other and which carry other electrical components, in particular electronic elements such as one or more microprocessors, one or more memory devices, potentiometers, terminals (e.g. clamped connections), displays, etc. A plate 11 may be configured for instance in the form of a printed circuit board ("PCB").

The lateral sides of each plate 11 is attached to a vertical plate 12 and to a holding part 13.

The control device 10 can be any electrical device which is adapted to transmit and/or to receive signals via the communication line 1. The signals are e.g. control signals and/or represent data. The control device 10 is in particular a device for automation and/or energy applications. Examples of the control device 10 are as follows:

- Devices for conducting, transforming, accumulating, regulating, measuring and/or controlling electricity, e.g. electronic timers, energy meters, programmable logic controllers, electric control panels, relays, etc.
- Electrical devices for energy management and/or energy savings, e.g. energy controllers, energy managers, energy loggers, displays, etc.
- Electrical devices for automation, e.g. controllers in particular for electrical cabinets, touch screens, displays, HMI ("Human Machine Interface") or other devices for machine and/or process automation, control and/or information units in particular for a building and/or a room, etc.

Figure 3A:
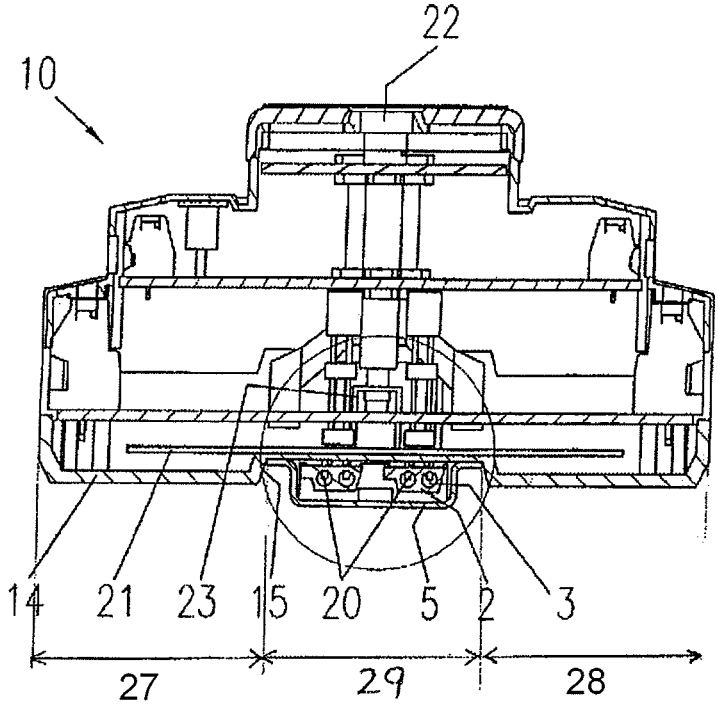
FIG. 3A shows a sectional side view of the network component according to FIG. 1, wherein the housing is not removed.
Figure 3B:
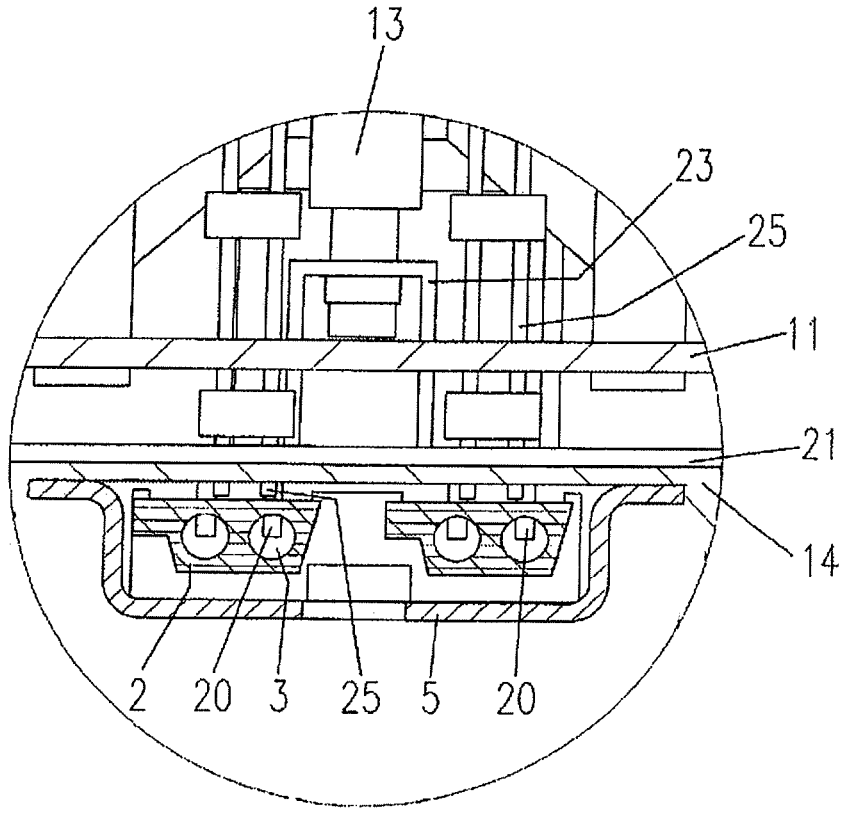
FIG. 3B shows a detailed view of the encircled part in FIG. 3A.

As can also be seen in FIGS. 3A and 3B, the control device 10 comprises pins 20 which project from the mounting side 14 of the control device 10, which is mounted on the mounting rail 5. The pins 20 are connected e.g. to one of the plates 11, from where the internal electric connections to the electrical components of the control device 10 are made. One of the plates 11 forms e.g. the main PCB.

The pins 20 are adapted to pierce the insulation jacket 2 for contacting the wires 3. For this purpose, the end of each pin 20 is substantially straight and has a pointed form. The distance between the pins 20 and their length are chosen in correspondence to the distance between the wires 3 and to the dimension of the insulation jacket 2.

The mounting side 14 of the control device 10 is configured such that it can be releasably attached to the mounting rail 5. In the present embodiment shown in FIG. 3A, the mounting side 14 has a recess 15 which is adapted to receive the mounting rail 5. That is, when mounting rail 5 includes lateral wings, recess 15 has a length 29, such that recess 15 can accommodate the entire width of mounting rail 5, including the lateral wings. In addition, network component, when mounted on the mounting rail 5, projects over the first lateral wing, that is, it extends beyond first lateral wing by first distance 27, and projects over second lateral wing, that is, it extends beyond the width of the lateral wing, by a second distance 28. The control device 10 may be provided with one or more suitable attachment elements for attaching releasably the control device 10 to the mounting rail 5. Such an attachment element may be e.g. in the form of a movable lever, such that, after attachment, a wing portion of the mounting rail 5 is held between the lever and the mounting side 14 of the control device 10.

The control device 10 can easily be connected to other control devices via the communication line 1 by mounting the control device 10 on the mounting rail 5, such that the pins 20 pierce the insulation jacket 2 and contact the wires 3. Since no additional wiring is needed to make the connection to the communication line 1, material and costs can be saved.

When required, the control device 10 can be removed from the mounting rail 5 again. The control device 10 and communication line 1 are configured such that mounting and dismounting can be done without interruption of the network ("Hot Swapping"). The material for the communication line 1 is chosen such that the holes, which are produced by the piercing pins 20, are closed by themselves when the control device 10 is removed from the mounting rail 5. This is achieved e.g. by choosing a soft, elastic material for the insulation jacket 2.

Figure 4:
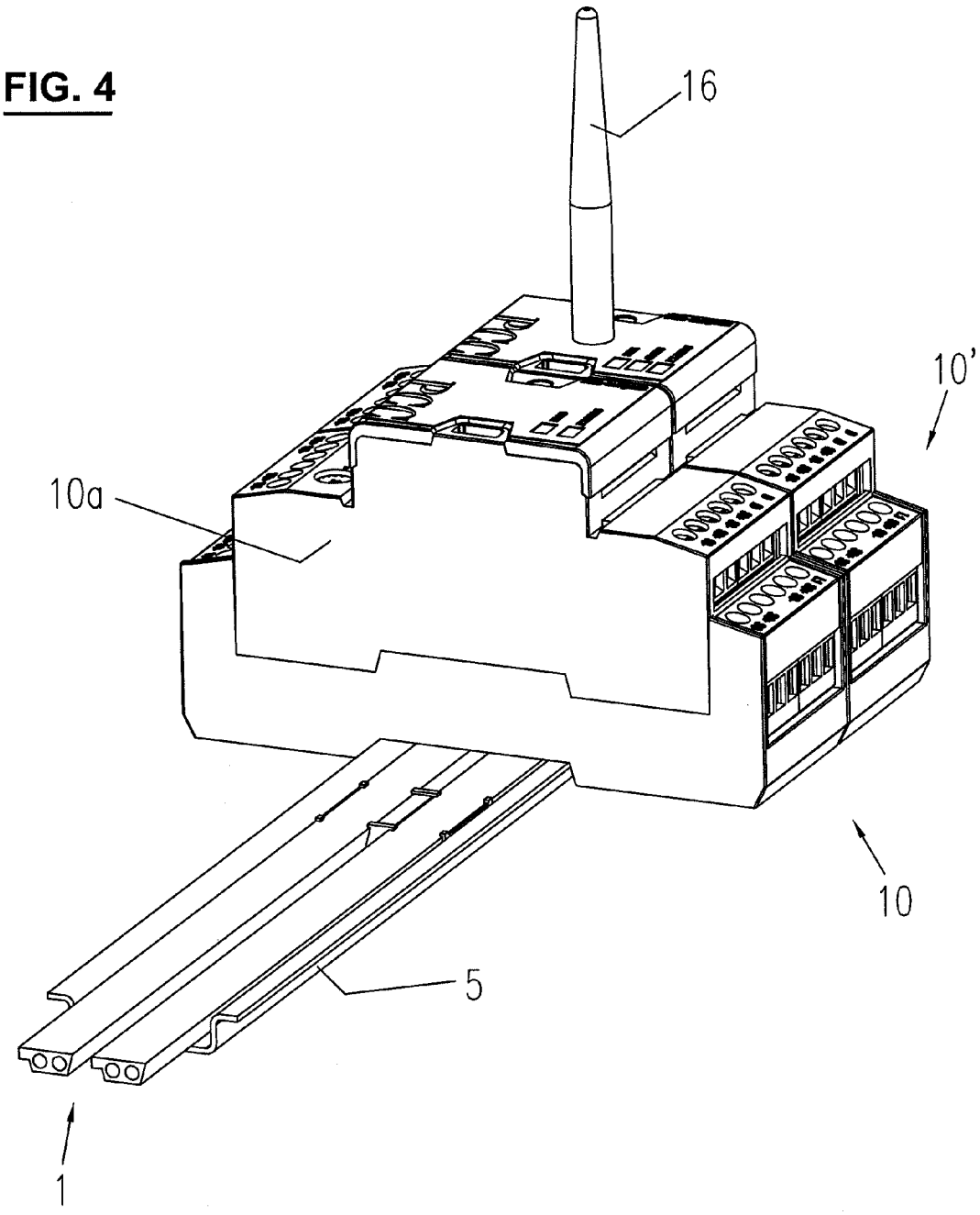
FIG. 4 shows the network component of FIG. 3A with an additional control device.

Another advantage is the saving of space as it is possible to position control devices close to each other on the mounting rail 5. FIG. 4 shows an example of another control device 10' which is positioned adjacent to the control device 10. Each control device 10, 10' has a housing whose lateral sides 10*a* are flat. The control device 10' shown here has an antenna 16, which—in addition to the communication via the communication line 1—enables a wireless communication.

In order to move the control device 10 along the mounting rail 5 and to position it precisely at a required position, the pins 20 are arranged movably in relation to the mounting side 14 and the electrical components of the control device 10. As is indicated by the double arrow 19 in FIG. 2, the pins 20 are movable in the movement direction, which is arranged transversely to the direction in which the wires 3 extend.

As also can be seen in FIG. 3A, the pins 20 are fixed to a movable plate 21. A screw 22 extends from the side which is opposite to the mounting side 14 through a hole in the holding part 13 and co-operates with the thread formed in a threaded element 23, which is fixed to the movable plate 21. The housing of the control device 10 has a recess 10*b* such that the end of the screw 22 is accessible to a user.

In order to establish the electrical contact between the pins 20, which are movable, and the fixed terminals of the control device 10, which the electrical components are connected to, intermediate pins 25 are provided for which extend from the rearward side of the movable plate 21. The forward ends of the intermediate pins 25 are in contact with the pins 20 and fixed to the movable plate 21 (cf. FIG. 3B). The rearward ends of the intermediate pins 25 are in sliding contact with the fixed terminals. Instead of using rigid intermediate pins 25 it is also conceivable to use flexible wires which connect the pins 20 with the fixed terminals of the control device 10.

Stops are provided for to define the distance of travel which the pins 20 can be moved. In the present embodiment, the holding part 13 serves as a first stop, which acts on the threaded element 23 when the pins 20 are moved away from the wires 3, and the inner part of the mounting side 14 serves as a second stop, which acts on the movable plate 21 when the pins 20 are moved towards the wires 3.

The first stop 13 defines the position of the pins 20 when retracted maximally and the second stop 14 defines the position of the pins 20 when extended maximally. The length of the pins and the stops 13, 14 are configured such that in the extended position the pins 20 do not go through the cable 2, 3, but ends therein, preferably within the wires 3 (cf. FIG. 3B).

Feedback means may be provided for to give the user an acoustic and/or haptic feedback when the pins 20 have reached a certain position. Such feedback means may comprise e.g. a stationary cantilever co-operating with the movable plate 21. The cantilever is bent when the plate 21 is moved towards the mounting rail 5 and—when the pins 20 are extended sufficiently—springs back which produces a specific sound.

The movable arrangement of the pins 20 allows the control device 10 to be placed at the desired position on the mounting rail 5 and to change the position if required. For mounting the control device 10, the pins 20 are positioned in the retracted position. The control device 10 is mounted on the mounting rail 5 and glided along the latter to the desired position. Then the screw 22 is screwed in such that the plate 21 and with it the pins 20 are moved towards the mounting rail 5. The pins 20 finally pierce the insulation jacket 2 and contact the wires 3. A reliable contact between the wires 3 and the pins 20 is given without the need of the provision of particular means producing a force on the pins 20.

If the control device 10 is to be moved to another position, the screw 22 is unscrewed such that the pins 20 are retracted and the control device 10 can be glided along the mounting rail 5 to the new position, where the pins 20 are again contacted with the wires 3 by screwing-in the screw 22.

From the preceding description, countless modifications are available to the expert without departing from the protective scope of the invention, which is defined by the claims.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A network component comprising an electrical device for exchanging signals via a communication line of a network, the electrical device being configured to be connected electrically to wires of the communication line, an insulation material enclosing the wires of the communication line, the insulation material including a first surface and a second surface, the first surface and the second surface being arranged on opposed sides of the insulation material, the network component having a mounting side and being mounted on a rail holding the wires such that the first surface of the insulation material faces the network component and the second surface of the insulation material faces the rail, the network component comprising:

pins positioned and configured to pierce the insulation material;

a mounting part with a mounting side for removably mounting the network component on the rail;

each pin includes an end for contacting a wire of the communication line, the end being straight and pointed and extending from the mounting side of the network component to pierce the insulation material through the first surface; and a housing comprising flat lateral sides arranged transversally to the rail when the network component is mounted thereon to position the network component close to another network component comprising another housing with flat lateral sides, wherein the pins are arranged in a movable manner relative to the mounting side of the network component.

2. The network component according to claim 1, wherein the mounting part comprises a recess for receiving the rail, the recess being formed on the mounting side of the network component.

3. The network component according to claim 1, further comprising holders positioned and configured to hold the wires of the communication line in the rail and to define a position of the wires relatively to lateral sides of the rail.

4. The network component according to claim 3, wherein the network component comprises the communication line, and at least one of said holders is formed integral with the insulation material of the communication line.

5. The network component according to claim 1, wherein the electrical device comprises at least one printed circuit board electrically connected to the pins.

6. The network component according to claim 1, wherein the pins are arranged in a fixed manner relative to the mounting side.

7. The network component according to claim 1, wherein the network device comprises a screwing mechanism positioned and configured to move the pins.

8. The network component according to claim 1, wherein the electrical device is a device for automation or for energy applications or for both.

9. The network component according to claim 1, wherein the network component is part of an electrical cabinet.

10. A network comprising at least one network component according to claim 1.

11. A network component comprising an electrical device for exchanging signals via a communication line of a network, the electrical device being configured to be connected electrically to wires of the communication line, the network component comprising:

pins configured to pierce an insulation material enclosing the wires of the communication line; and a mounting part for removably mounting the network component on a rail;

the rail including a first lateral wing, a second lateral wing, and a channel configured to receive the wires, and the channel is positioned between the lateral wings, each lateral wing projecting laterally from the channel, wherein the mounting part comprises a recess for receiving the lateral wings of the rail, the recess being formed on a mounting side of the network component, and the pins are arranged within the recess and project from the mounting side; and the network component further comprising holders configured to hold the wires of the communication line in the rail and to define a position of the wires relatively to lateral sides of the channel of the rail.

12. The network component according to claim 11, wherein at least one of said holders is formed integral with the insulation material of the communication line.

13. The network component according to claim 11, wherein the electrical device comprises a housing with flat lateral sides, and the flat lateral sides are positioned transversally to the rail when the network component is mounted thereon to position the network component close to another network component comprising another housing with flat lateral sides.

14. The network component according to claim 11, wherein the electrical device comprises at least one printed circuit board which is electrically connected to the pins.

15. The network component according to claim 11, wherein the pins are arranged in a fixed manner relative to the mounting side of the network component.

16. The network component according to claim 11, wherein each pin includes a straight and pointed end.

17. A network comprising at least one network component according to claim 11.

18. The network component according to claim 11, wherein the network component comprises a housing in which the recess is formed, the housing including lateral walls defining the recess and being arranged inclined to each other such that the recess narrows when seen towards the mounting side.

19. The network component according to claim 11, wherein the network component when mounted on the rail projects over the first lateral wing with a first distance and over the second lateral wing with a second distance, and the recess has a length which corresponds to the distance between the lateral wings and which is smaller than the sum of the first distance and the second distance.

20. A network component comprising an electrical device for exchanging signals via a communication line of a network, the electrical device being configured to be connected electrically to wires of the communication line, the network component comprising:

pins configured to pierce an insulation material enclosing the wires of the communication line; and a mounting part for removably mounting the network component on a rail;

the rail including a first lateral wing, a second lateral wing, and a channel configured to receive the wires, and the channel is positioned between the lateral wings, each lateral wing projecting laterally from the channel, wherein the mounting part comprises a recess for receiving the lateral wings of the rail, the recess being formed on a mounting side of the network component, and the pins are arranged within the recess and project from the mounting side, wherein the pins are arranged in a movable manner relative to the mounting side of the network component.

21. The network component according to claim 20, wherein the network component comprises a screwing mechanism positioned and configured to move the pins.

* * * * *